US005223316A

United States Patent [19]

Nemzin et al.

[11] Patent Number: 5,223,316

[45] Date of Patent: Jun. 29, 1993

[54] SUPPORT FRAME FOR PREDETERMINED CHARACTERS

[75] Inventors: William K. Nemzin; Brenda R. Nemzin, both of Houston, Tex.

[73] Assignee: Centro Manufacturing Co., Ltd., Tex.

[21] Appl. No.: 821,821

[22] Filed: Jan. 17, 1992

[51] Int. Cl.[5] ..... E06B 1/26

[52] U.S. Cl. ..... 428/45; 40/596; 428/187

[58] Field of Search ..... 40/618, 595, 596; 428/7, 33, 187, 45

[56] References Cited

U.S. PATENT DOCUMENTS

| | | | |
|---|---|---|---|
| 2,039,248 | 4/1936 | Huppert | 40/618 |
| 2,411,187 | 11/1946 | Boogher | 428/187 X |
| 2,598,507 | 5/1952 | Cohn | 40/618 |
| 2,630,643 | 3/1953 | Smithson et al. | 40/618 |
| 3,270,452 | 9/1966 | D'Elia et al. | 40/618 |
| 4,579,768 | 4/1986 | Post | 428/187 |
| 4,819,356 | 4/1989 | Spidell | 40/618 |

FOREIGN PATENT DOCUMENTS

| | | | |
|---|---|---|---|
| 749444 | 5/1956 | United Kingdom | 428/187 |

*Primary Examiner*—Henry F. Epstein
*Attorney, Agent, or Firm*—Bush, Moseley & Riddle

[57] ABSTRACT

A support frame (10) for a plurality of predetermined characters (24A–24G) removably mounted in openings (22A–22G) of associated holders (20A–20G). The holders (20A–20G) are press fitted within a generally rectangular opening (14) of an outer frame member (12). Tongue and groove combinations (21, 26) retain holders (20A–20G) within the outer frame member (12). The characters (24A–24G) may comprise alphabetical letters, numerals, or various symbols.

9 Claims, 1 Drawing Sheet

SUPPORT FRAME FOR PREDETERMINED CHARACTERS

FIELD OF THE INVENTION

This invention relates to a support frame for a plurality of predetermined characters, and more particularly to such a support frame for removable preselected characters.

BACKGROUND OF THE INVENTION

Various sign boards or frames have been utilized heretofore for mounting removable letters and numerals therein. Such letters and numerals have been retained in such frames by various retaining means such as adhesives, or fitting in slots, for example. Many of such sign boards or frames are designed for outdoor use and have been formed of various types of rigid materials, such as wood, metal or rigid plastic material. Oftentimes, a backing is required for supporting the removable letters. Puzzles utilizing the placement of interfitting pieces have normally comprised the placement of preselected pieces on the back of a puzzle frame which provides support for the pieces.

SUMMARY OF THE INVENTION

The present invention is directed to a support frame particularly for preselected characters removably fitted within block like holders which are easily press fitted within an outer supporting frame member. The outer frame member has a central opening of a generally rectangular shape therethrough and the block like holders are press fitted within tongue and groove combinations for removably retaining the holders within the outer frame member. The support frame including the block like holders and characters are formed of the same material which is a resilient plastic material, preferably EVA. The block like holders are of a generally rectangular shape and have openings therein of the same shape as the characters mating to be press fitted therein. Thus, each holder is associated with a specific character. While the character will usually comprise an alphabetical letter, the character may comprise a symbol of animals, vehicles, or the like. As used herein, the term "character" is interpreted as any letter, figure, numeral, or symbol used in writing or printing, such as alphabetical letters, numerals, or symbols of animals, vehicles, persons, or the like. Some of the block like holders are utilized as spacers without any opening therein to receive characters.

Such a support frame for characters is particularly adapted for use as a puzzle or educational game for children and has adequate space in which to receive the name of a person, for example. Thus, the support frame may be utilized to assist a child in the spelling of a first name.

It is an object of this invention to provide a support frame for preselected characters which are removably mounted in block like holders removably mounted on the support frame.

It is a further object of this invention to provide such a support frame having an outer frame member with a generally rectangular central opening to receive and retain the block like holders therein with a press fit.

Other objects, features, and advantages of this invention will become more apparent after referring to the following specification and drawings.

DESCRIPTION OF THE INVENTION

Figure 1:
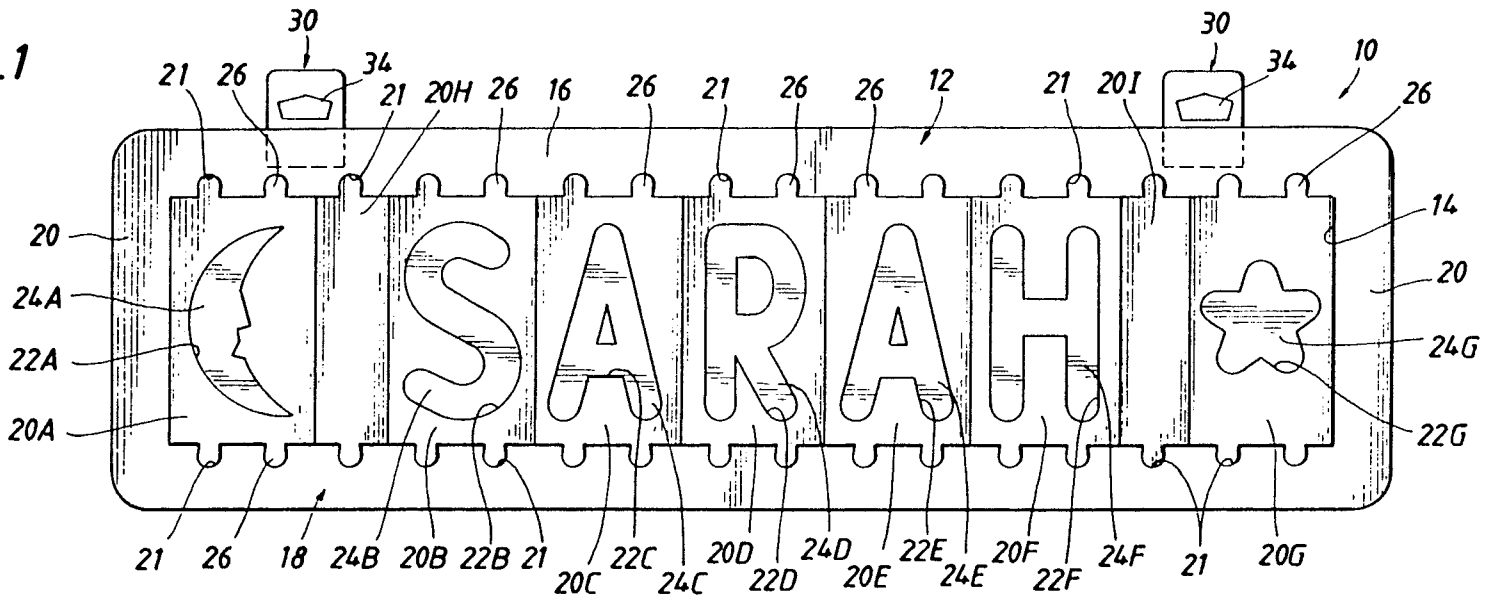
FIG. 1 is a front elevation of the support frame for predetermined characters of the present invention.
Figure 2:
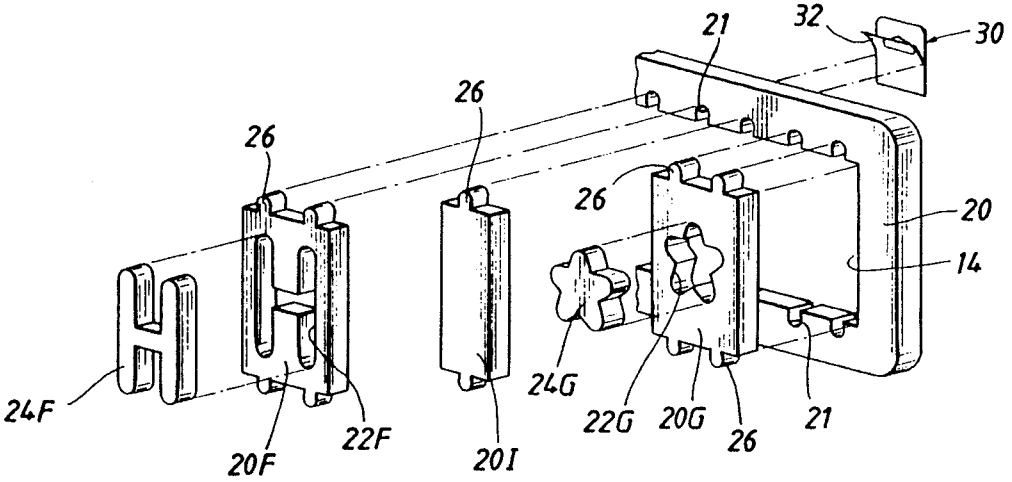
FIG. 2 is an exploded view of a portion of the support frame shown in FIG. 1 with certain block like holders removed from the frame and the associated characters removed from the holders.

Referring now to the drawing for a better understanding of this invention, the support frame is generally indicated at 10 and includes an outer frame member 12 having a central opening 14 therethrough of a generally rectangular shape. Upper and lower sides 16 and 18 of frame member 12 are connected by ends 20 to define opening 14. A plurality of grooves or slots 21 are equally spaced along inner peripheral surfaces of upper and lower sides 16 and 18.

A plurality of block like holders 20A, 20B, 20C, 20D, 20E, 20F, 20G, and block like spacer members 20H and 20I are mounted within opening 14 to fill the space created by opening 14. Holders 20C and 20E are identical and spacer members 20H and 20I are identical. The remaining holders 20A, 20B, 20D, 20F, and 20G are each different. Holders 20A–20G have openings 22A–22G therethrough which receive removable mating characters 24A–24G in a press fit to retain characters 24A–24G therein.

Each holder 20A–20G has a pair of tongues or projections 26 along upper and lower sides thereof for fitting within grooves 21 with a press fit to retain holders 20A–20G therein. It is noted that spacers 20H and 20I are of a half width and have only a single tongue 26 along upper and lower side thereof. Removable characters 24A–24G as shown for holders 20A–20G include symbols and alphabetical letters. End holders 20A and 20G have characters 24A and 24G therein which are respective symbols of a quarter moon and a star. Holders 20B–20F include alphabetical letters which spell the name "SARAH". Thus, support frame 10 can be utilized as an educational game for children. Holders 20A–20G and the associated characters 24A–24G are of contrasting colors so that the characters can be easily distinguished from their associated receiving holders. Outer frame member 12 is preferably of a single color which contrasts with the colors of holders 20A–20G.

The entire support frame 10 including holders 20A–20G and characters 24A–24G are formed of the same resilient plastic material. A material which has been found to be satisfactory is EVA which provides resilience and a smooth outer surface. Also, the material has a density of around 0.040 grams per cubic centimeter ($g/cm^3$) which is relatively small to permit flotation of support frame 10 on water which may be desirable for children in a bath tub, for example. Other materials which may be utilized include wood, cardboard or plastics such as polyurethane, polystyrene or polycarbonate.

In use, outer frame member 12 without any spacers or holders in opening 14 is first presented to a user for filling of the empty space created by opening 14 with preselected holders. Normally, space would be provided by opening 14 adequate to receive eight (8) holders which would be sufficient to spell most first names. As indicated in FIG. 1, five (5) holders are utilized for spelling "SARAH" and end holders having symbols are utilized along with spacers 20H and 20I. The tongues or projections 26 of the block like holders 20A-20G are easily pressed within grooves 21 to retain the holders in position. The characters 24A-24G are usually press fitted with their respective mating holders 20A-20G prior to insertion of the holders within outer frame member 12.

For mounting support frame 10 on a wall or the like, a pair of hanger tabs are indicated generally at 30. Hanger tabs 30 include a peel-off strip 32 which exposes a pressure sensitive adhesive for adhering to outer frame member 12. Tabs 30 have openings 34 which are adapted to receive a nail or other mounting member secured to the adjacent wall for mounting support frame 10.

It may be desirable under certain conditions to utilize support frame 10 as a sign. For this purpose, outer frame member 12 may include additional lettering such as might be added by a silk screen process to outer frame member 12 which may be of an increased width to provide adequate space for the desired lettering. While the symbols shown in the drawings are representative of a star and moon, it is to be understood that the symbols may be representative of various selective objects, such as animals, boats, automobiles, persons, trains, buildings, or the like.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A support frame for predetermined characters comprising:

an outer frame member having a generally central opening therein;

a plurality of block members of a rectangular shape adapted to be removably positioned within said central opening in side-by-side relation;

releasable retaining means for said block members between each of said block members and said outer frame member for releasably mounting said block members to said outer frame member within said opening, said releasable retaining means comprising cooperating interfitting members on said block members and said outer frame member;

at least some of said block members having an opening therein of a predetermined shape and size similar to a predetermined alphabetical character for receiving the predetermined character therein; and predetermined selected alphabetical characters adapted to be removably positioned within mating openings in said block members.

2. A support frame as set forth in claim 1 wherein said outer frame member is of a generally rectangular shape and said opening therein is of a generally rectangular shape.

3. A support frame as set forth in claim 2 wherein said releasable retaining means between said block members and said outer frame member comprises mating tongue and groove connections.

4. A support frame as set forth in claim 1 wherein said releasable retaining means for said block members comprises a plurality of equally spaced cooperating tongue and groove combinations between said block members and said outer frame member, each of said block members including in combination with said outer frame member a pair of upper cooperating tongue and groove combinations and a pair of lower cooperating tongue and groove combinations.

5. A support frame as set forth in claim 4 wherein additional block members are provided as spacers, and releasable retaining means are provided for said additional block members comprising an upper cooperating tongue and groove combination and a lower cooperating tongue and groove combination between said additional block members and said outer frame member.

6. A support frame as set forth in claim 5 wherein said additional block members are solid members without any openings therein.

7. A support frame for visually presenting a name in alphabetical letters comprising:

an outer frame member of a generally rectangular shape having a generally rectangular central opening therethrough;

a plurality of generally rectangular block holders adapted to be removably positioned within said central opening in side-by-side relation, each holder having an opening therethrough of a predetermined size and shape adapted to receive a selected alphabetical letter therein;

releasable mounting means for said holders comprising upper and lower cooperating tongue and groove combinations between said outer frame member and said holders, said tongue and groove combinations being equally spaced along said rectangular opening in said outer frame member; and a plurality of preselected alphabetical letters for fitting within complementary openings in said holders in a press fit.

8. A support frame as set forth in claim 7 wherein said outer frame member, said holders, and said alphabetical letters are formed of a resilient plastic material, said holders and said associated letters being formed of different contrasting colors so that said letters are easily distinguishable.

9. A support frame as set forth in claim 7 wherein additional holders are provided as end spacers, said additional holders adapted to be positioned adjacent the ends of said first mentioned holder for said alphabetical letters.

* * * * *